US006222438B1

(12) United States Patent
Horibe et al.

(10) Patent No.: US 6,222,438 B1
(45) Date of Patent: Apr. 24, 2001

(54) TEMPERATURE FUSE AND APPARATUS FOR DETECTING ABNORMALITY OF WIRE HARNESS FOR VEHICLE

(75) Inventors: Kinya Horibe; Takayoshi Endo; Takashi Ishii, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/109,047

(22) Filed: Jul. 2, 1998

(30) Foreign Application Priority Data

Jul. 4, 1997 (JP) ..... 9-179536

(51) Int. Cl.[7] ..... H01H 85/06; H01H 85/055

(52) U.S. Cl. ..... 337/290; 337/296; 337/160; 337/416; 29/623

(58) Field of Search ..... 337/227, 297, 337/232, 166, 404, 159, 160, 298, 401, 402, 403, 405, 416, 290, 296; 29/623

(56) References Cited

U.S. PATENT DOCUMENTS

| | | | | |
|---|---|---|---|---|
| 3,386,083 | * | 5/1968 | Mansfield, Jr. | 337/191 |
| 3,699,395 | * | 10/1972 | Boleky | 317/101 |
| 4,127,839 | * | 11/1978 | Ito et al. | 337/408 |
| 4,489,301 | * | 12/1984 | Johnson et al. | 337/401 |
| 4,503,415 | * | 3/1985 | Rooney et al. | 337/160 |
| 4,652,848 | * | 3/1987 | Hundrieser | 337/297 |
| 4,691,197 | * | 9/1987 | Damiano et al. | 340/638 |
| 5,221,038 | * | 6/1993 | Melton et al. | 228/180.2 |
| 5,304,740 | * | 4/1994 | Bozell et al. | 174/110 PM |
| 5,329,421 | * | 7/1994 | Kuriyama | 361/534 |
| 5,389,573 | * | 2/1995 | Itagaki | 437/180 |
| 5,429,530 | * | 7/1995 | Zander et al. | 439/622 |
| 5,604,474 | * | 2/1997 | Leach et al. | 337/158 |
| 5,631,621 | * | 5/1997 | Nakajima | 337/280 |

FOREIGN PATENT DOCUMENTS

| | | | | |
|---|---|---|---|---|
| 53-33349 | | 3/1978 | (JP) | H01H/85/08 |
| 56-114238 | | 9/1981 | (JP) | H01H/37/76 |
| 403074026A | * | 2/1995 | (JP) | H01H/85/11 |
| 408227642A | * | 2/1995 | (JP) | H01H/37/76 |

OTHER PUBLICATIONS

Nippon Kinzoku Gakkai, *Metals Data Book*, 3rd revised ed. (1993), p. 554.

* cited by examiner

*Primary Examiner*—Leo P. Picard
*Assistant Examiner*—Anatoly Vortman
(74) *Attorney, Agent, or Firm*—Sughrue, Mion, Zinn & Seas, PLLC

(57) ABSTRACT

A temperature fuse which is melted with high operating temperature accuracy at a desired predetermined temperature in the range of 140° C. to 160° C. A fuse element is made of an alloy consisting essentially of 52–100 wt. % indium and the balance tin, and with this construction there can be achieved the temperature fuse which is melted with high operating temperature accuracy at a desired predetermined temperature in the range of 140° C. to 160° C.

27 Claims, 4 Drawing Sheets

TEMPERATURE FUSE AND APPARATUS FOR DETECTING ABNORMALITY OF WIRE HARNESS FOR VEHICLE

BACKGROUND OF THE INVENTION

1. Field of the Invention

This invention relates to a temperature fuse and an apparatus for detecting abnormality of a wire harness for a vehicle, and the invention is best suited for detecting an abnormal heat generation caused in the wire harness due to, for example, a rare short (short-circuit).

The present application is based on Japanese Patent Application No. Hei. 9-179536, which is incorporated herein by reference.

2. Description of the Related Art

In order that lead wires can be positively insulated from each other when a fuse element is melted, there have heretofore been extensively used, as temperature fuses (heat-sensitive fuses), surface tension-operating type fuses in which a fuse element 1 is made of a material liable to adhere to lead wires 2 when the fuse element 1 is melted, as shown in FIGS. 5 and 6.

This fuse element 1 is formed by adding an appropriate amount of lead to a binary eutectic alloy of 47–49 wt. % tin and 53–51 wt. % indium so that the fuse element 1 can be melted in a temperature range of 120 to 135° C., and in this temperature fuse, the molten fuse element 1 provides a sufficient surface tension, and a variation in operating temperature is much reduced. This temperature fuse is proposed in Unexamined Japanese Patent Publication No. Sho. 56-114238.

Such a temperature fuse has been extensively used as a temperature detection portion in various electronic equipments. Here, let's consider the case where such a temperature fuse is used as means for detecting the temperature of a wire harness installed in a vehicle.

First, the need for detecting the temperature of a wire harness will be described. In a vehicle, generally, electric power, produced by a power source such as a battery and an alternator, is supplied to various loads through a wire harness comprising a plurality of wires. As shown in FIG. 7, this wire harness 11 comprises many conductors 11*a* covered and protected by an insulating sheath 11*b* made, for example, of polyvinyl chloride. Namely, the wire harness is bundled and protected by fitting soft vinyl chloride thereon or by winding a tape therearound, thereby preventing the (electricity) leakage from the conductors 11*a*.

Generally, a wire harness is connected to a fuse (which is a current-interrupting fuse, and is different from a temperature fuse), and this arrangement prevents damage to loads and the deterioration of wires which would be caused by an excessive current produced when a voltage variation develops in a power source (such as a battery and an alternator) and when a dead short of the wire develops.

The connection of this wire harness to the fuse is made, for example, by a fuse box 12 shown in FIG. 8. The fuse box 12 comprises a housing 15 of an insulative, heat-resistant resin in which a fuse element 13 is received, and one end of the wire harness is connected to terminals 14*a* and 14*b* provided respectively at opposite ends of the fuse element 13.

Generally, a fuse, used in a vehicle, has such melting characteristics that the fuse is melted immediately when a current of a value more than 200% of its rated value flows therethrough, but the melting time for a current of a value less than 200% of the rated value is relatively long since the fuse is designed to withstand a rush current.

There are occasions when the conductors 11*a* are brought into contact with a vehicle body as a result of aged deterioration of the insulating sheath 11*b* or wear of the insulating sheath 11*b* by contact with an edge portion of the vehicle, that is, a so-called dead short or a so-called rare short (intermittent short-circuit) develops. In the former case, a large current flows through the fuse, and therefore the fuse is melted immediately, but in the latter case, the heat generation and heat radiation alternately occur in the fuse, so that there is a tendency; that a longer time is taken until the fuse is melted.

Therefore, when the rare short continues, there is a possibility that the insulating sheath 11*b* of the wire harness 11 serves as a heat accumulator before the melting of the fuse, so that the temperature of the insulating sheath 11*b* increases. As a result, the insulating sheath 11*b* is further deteriorated.

Therefore, it is thought that if there is a temperature fuse capable of detecting the temperature of the wire harness, this is very convenient. It is particularly desired to provide a temperature fuse capable of accurately detecting a temperature condition in which the wire harness rises to a temperature in the range of between 140° C. and 160° C. Referring to the reason for this, in view of the material of the wire harness, if the temperature lower than 140° C. is detected, and this is judged as an abnormal condition, the wire harness is decided as being abnormal even though the wire harness is not still much deteriorated, and therefore this not suitable. In contrast, if the relevant temperature is more than 160° C., there is a possibility that the deterioration of the wire harness is not prevented. Therefore, it is necessary to provide the temperature fuse which is melted accurately at the desired predetermined temperature in the range of 140° C. and 160° C.

SUMMARY OF THE INVENTION

With the foregoing in view, it is an object of this invention to provide a temperature fuse which is melted in a predetermined temperature range of 140° C. and 160° C. with high operating temperature accuracy.

Another object of the invention is to provide an apparatus for detecting abnormality of a wire harness for a vehicle, which prevents the deterioration of the vehicle wire harness due to a rare short and others.

In order to achieve the above object, according to the first aspect of the present invention, there is provided a temperature fuse comprising a fuse element which is melted when the ambient temperature exceeds a certain temperature;

wherein the fuse element is made of an alloy consisting essentially of 52–100 wt. % indium and the balance tin.

In this construction, the melting temperature of the fuse element of this weight ratio is about 120° C. to about 160° C., and by changing the ratio within the range of this weight ratio, a desired operating temperature of 120° C. to 160° C. can be set. A gap between a liquidus line and a solidus line of the fuse element of this weight ratio is as narrow as several degrees (° C.), and the temperature difference between the two is small, and therefore there can be obtained the temperature fuse having the high operating temperature accuracy. Incidentally, in an indium-tin alloy, if the tin content is not more than 48 wt. %, there occurs a so-called peritectic reaction in which a liquid reacts with an equilibratorily-coexisting crystal to form another crystal to embrace the original crystal, and therefore the gap between the liquidus and the solidus is as narrow as several degrees (° C.). Therefore, there can be achieved the temperature fuse which is melted with high operating temperature accuracy at the desired, predetermined temperature in the range of between 120° C. and 160° C.

According to the second aspect of the present invention, there is provided a temperature fuse comprising a fuse element which is melted when the ambient temperature exceeds a certain temperature;

wherein the fuse element is made of an alloy consisting essentially of 85–100 wt. % indium and the balance tin.

In this construction, the melting temperature of the fuse element of this weight ratio is about 140° C. to about 160° C., and by changing the ratio within the range of this weight ratio, a desired operating temperature of 140° C. to 160° C. can be set. A gap between a liquidus line and a solidus line of the fuse element of this weight ratio is as narrow as several degrees (° C.), and the temperature difference between the two is small, and therefore there can be obtained the temperature fuse having the high operating temperature accuracy. Therefore, there can be achieved the temperature fuse which is melted with high operating temperature accuracy at the desired, predetermined temperature in the range of between 140° C. and 160° C.

According to the third aspect of the present invention, the fuse element is covered with a paraffin substance.

In this construction, when the ambient temperature exceeds a certain temperature, so that the fuse element is melted, the paraffin substance embraces the melted fuse element, and therefore separated portions of the melted fuse element are prevented from being connected together.

According to the fourth aspect of the present invention, the fuse element is covered with an insulating film.

In this construction, when the fuse element is made of an alloy consisting of 52–100 wt. % indium and the balance tin or an alloy consisting of 85–100 wt. % indium and the balance tin, this fuse element is very soft, and therefore can not be easily handled when it is processed into the predetermined shape. When the fuse element is covered with the insulating film, the melted fuse element is prevented from being dissipated, and besides that portion of the temperature fuse around the fuse element is made rigid by the rigidity or hardness of the insulating film, and the temperature fuse can be easily handled.

According to the fifth aspect of the present invention, the paraffin substance is covered with an insulating film.

According to the sixth aspect of the present invention, the insulating film is made of a thermosetting resin.

In the above construction, the fuse element, when melted, becomes softer, but the hardness of the thermosetting resin increases, and therefore the outer shape of the temperature fuse is maintained.

According to the seventh aspect of the present invention, lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

In this construction, when the fuse element is directly joined to the lead wire, the fuse element is subjected to sagging since there is the large difference in hardness between the lead wire and the fuse element, and it is thought that the temperature fuse can not be satisfactorily formed into a desired shape at a desired position. Therefore, with this construction, the detection wire or line becomes softer gradually from the lead wire to the fuse element, and therefore the shaping of the detection wire can be effected easily.

In an apparatus for detecting abnormality of a wire harness for a vehicle according to the eighth aspect of the present invention, a temperature fuse as defined in any one of the first to seventh aspects is provided inside or adjacent to the wire harness, and there is provided means for detecting the severing of the temperature fuse so as to detect an abnormal condition of the wire harness.

In this construction, the temperature rise of the wire harness can be detected, using the temperature fuse which is melted accurately at the desired predetermined temperature in the range of 140° C. to 160° C., and therefore there can be achieved the wire harness abnormality detection apparatus which positively detects the abnormal heat generation in the wire harness, and prevents the deterioration of the wire harness due to a rare short and others.

DETAILED DESCRIPTION OF THE PREFERRED EMBODIMENT

One preferred embodiment of the present invention will now be described with reference to FIGS. 1–4.

Figure 1:
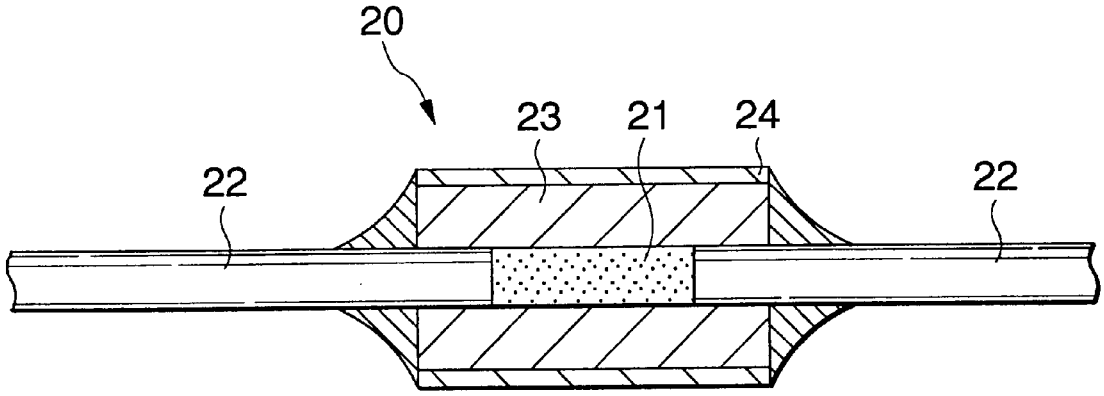
FIG. 1 is a cross-sectional view showing the construction of a temperature fuse of the present invention.

FIG. 1 shows the construction of a temperature fuse 20 of this embodiment. A fuse element 21 is provided at a cut-off portion of a lead wire 22, and this fuse element 21 is made of an alloy consisting essentially of 52–100 wt. % indium and the balance tin. In the temperature fuse 20, by changing the ratio within the range of this weight ratio, a desired operating temperature can be set to a desired value between 120° C. and 160° C.

Figure 2:
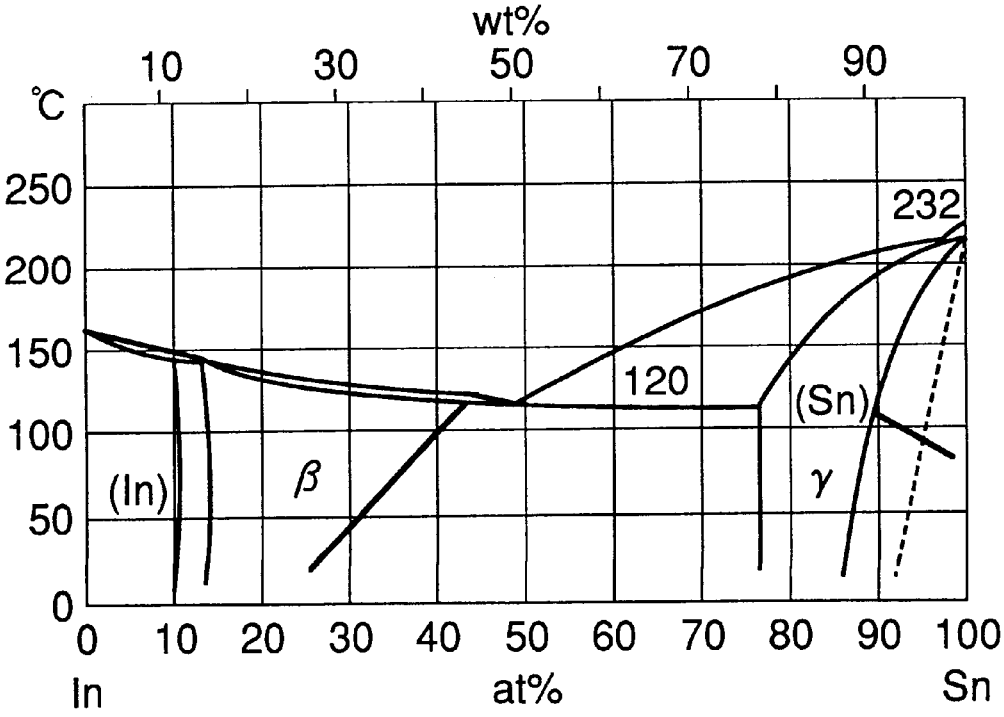
FIG. 2 is a diagram showing an indium-tin alloy.

As indicated in a diagram of FIG. 2, the melting temperature of the fuse element 21 (made of the alloy consisting essentially of 52–100 wt. % indium and the balance tin) is about 120° C. to about 160° C., and the gap between a liquidus line and a solidus line of the fuse element 21 of this weight ratio is as narrow as several degrees (° C.), and the temperature difference between the two is small, and therefore there can be obtained the temperature fuse 20 having the high operating temperature accuracy. Therefore, there can be achieved the temperature fuse 20 which is melted with high operating temperature accuracy at the desired, predetermined temperature in the range of between 120° C. and 160° C.

The fuse element 21 is covered with an insulating film 24 of a thermosetting resin. In this embodiment, polyethylene is used as the insulating film 24. Therefore, in the temperature fuse 20, the fuse element 21, when melted, is prevented from being dissipated, and besides that portion of the temperature fuse 20 around the fuse element 21 is made rigid by the rigidity or hardness of the insulating film 24, and the temperature fuse 20 can be easily handled.

Figure 3:
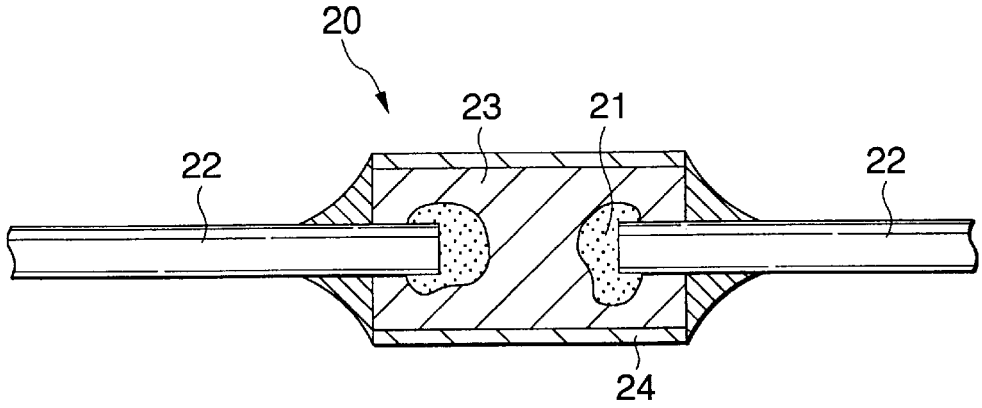
FIG. 3 is a cross-sectional view showing a molted condition of the temperature fuse.

A paraffin substance (hydrocarbon) 23, represented by a general formula ($C_nH_{2n+2}$), is filled in a space between the fuse element 21 and the insulating film 24. Therefore, in the temperature fuse 20, when the ambient temperature exceeds a certain temperature, so that the fuse element 21 is melted, the paraffin substance 23 embraces the melted fuse element 21 as shown in FIG. 3, and therefore separated portions of the melted fuse element 21 are prevented from being connected together.

Figure 4:
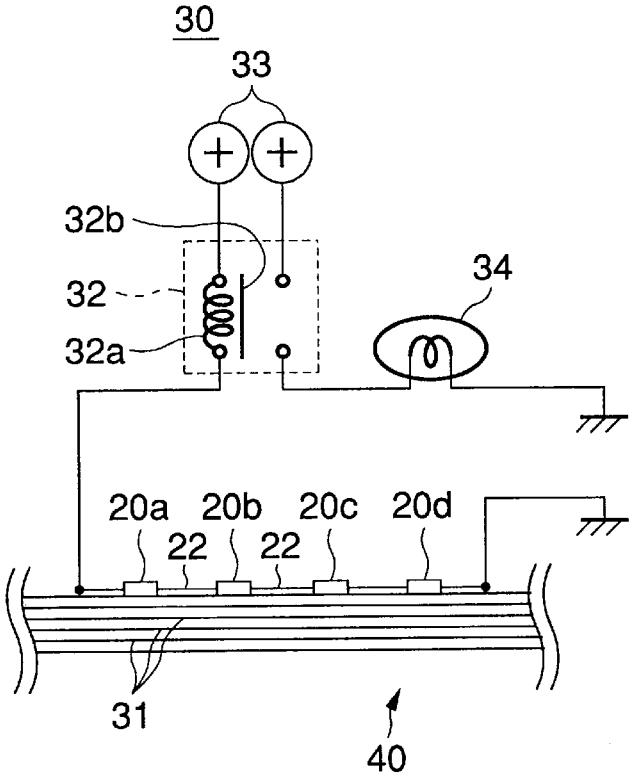
FIG. 4 is a schematic diagram showing the construction of a vehicle wire harness abnormality detection apparatus of the invention.
Figure 5:
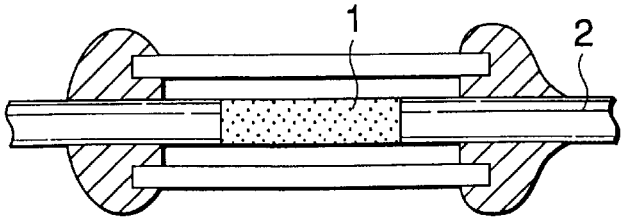
FIG. 5 is a cross-sectional view showing the construction of a conventional temperature fuse.
Figure 6:
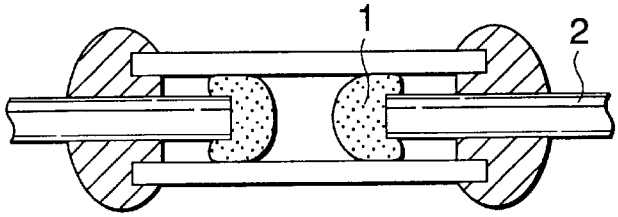
FIG. 6 is a cross-sectional view showing a melted condition of the conventional temperature fuse.
Figure 7:
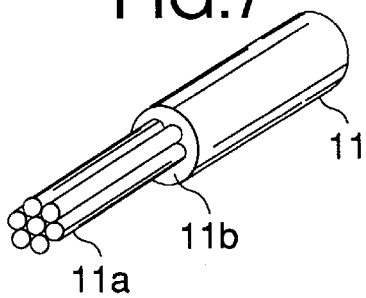
FIG. 7 is a perspective view showing the construction of an ordinary wire harness.
Figure 8:
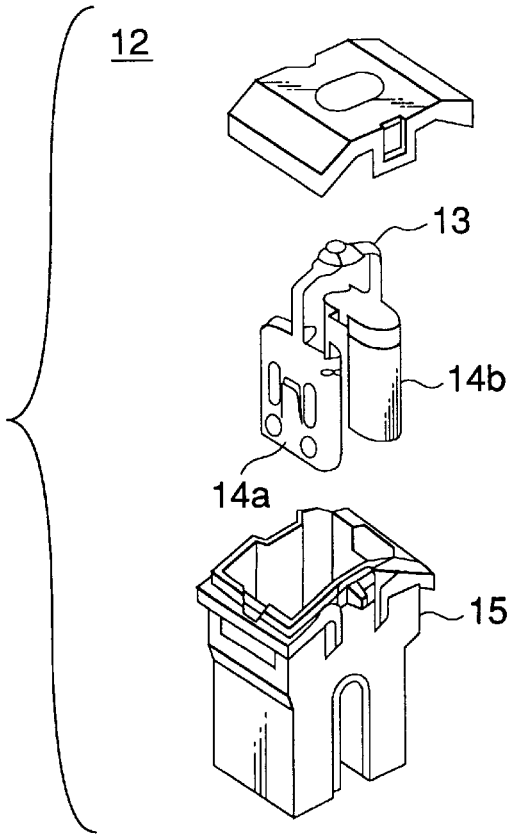
FIG. 8 is a perspective view showing the construction of a fuse box.
Figure 9:
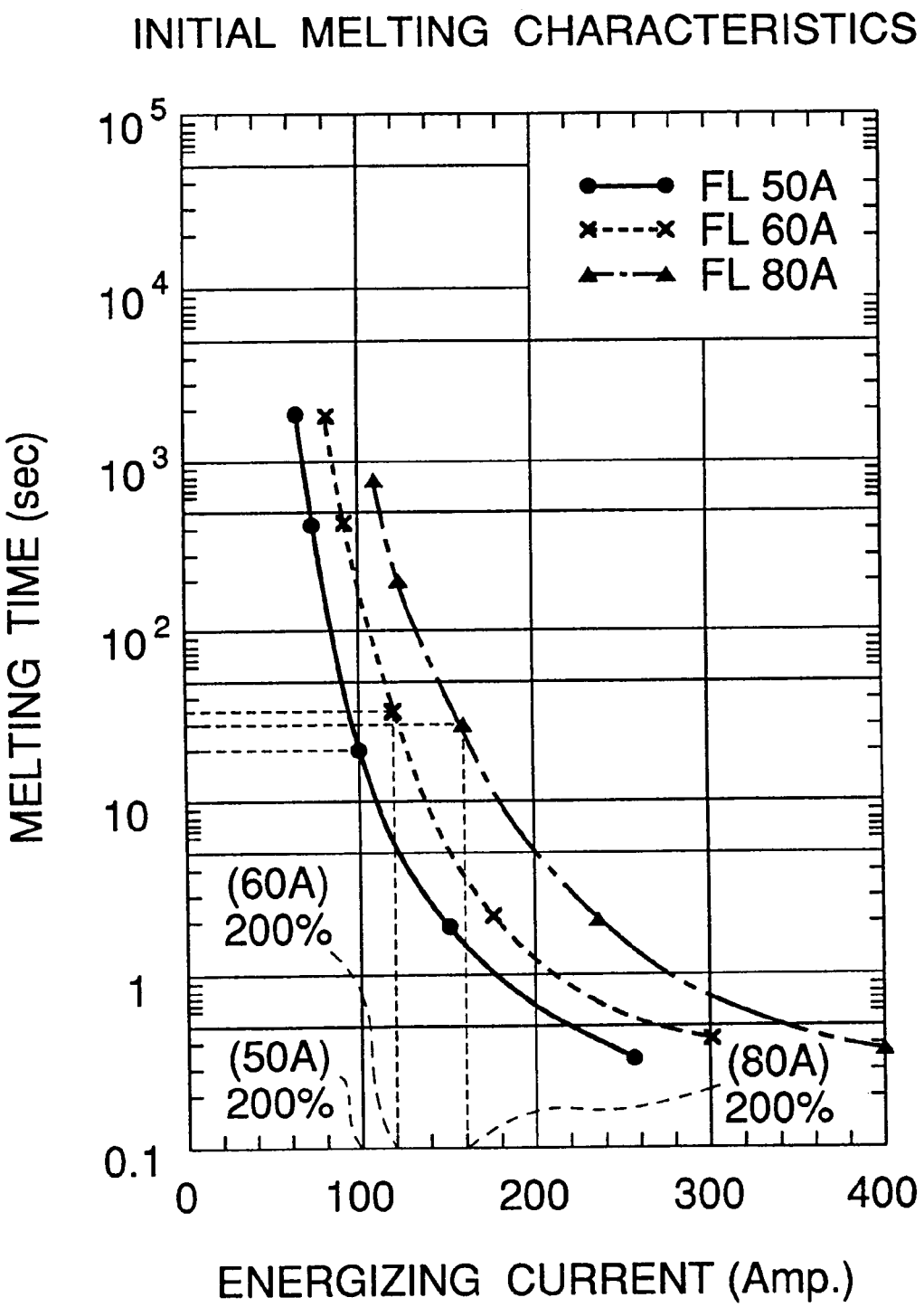
FIG. 9 is a graph showing melting characteristics of a fuse used in a vehicle.

Next, an apparatus for detecting abnormality of a wire harness for a vehicle will be described, the apparatus using the temperature fuses 20. As shown in FIG. 4, in this abnormality detection apparatus 30, temperature fuses 20*a* to 20*d* each similar in construction to the temperature fuse 20 are arranged adjacent to wires 31, and the wires 31 and the temperature fuses 20*a* to 20*d* are covered with an insulating film (not shown).

Voltage is applied to the temperature fuses 20*a* to 20*d*, serially connected together by a lead wire 22, from a voltage supply circuit 33 via an electromagnetic relay 32, so that a very small current flows through the lead wire 22 and the temperature fuses 20*a* to 20*d*.

With this construction, when the wire harness 40 is in a normal condition, the current flows through a coil 32*a* of the electromagnetic relay 32, the lead wire 22 and the temperature fuses 20*a* to 20*d*, and therefore a terminal plate 32*b* of the electromagnetic relay 32 is held in the OFF state as shown in the drawings.

On the other hand, when a rare short develops in the wire harness 40, so that the temperature of the wire harness 40 rises to a certain value between 140° C. and 160° C., the temperature fuse 20*a*, 20*b*, 20*c* or 20*d*, disposed at this region, is melted, and therefore the current ceases to flow through the coil 32*a* of the electromagnetic relay 32, the lead wire 22 and the temperature fuses 20*a* to 20*d*, so that the terminal plate 32*b* is brought into the ON state. At this time, the voltage is applied to an alarm lamp 34 from the voltage supply circuit 33 to turn on this alarm lamp 34.

Thus, the wire harness abnormality detection apparatus 30 can tell the user of the fact that the temperature of the wire harness 40 had exceeded the predetermined level or temperature. When the abnormal condition is thus detected by the wire harness abnormality detection apparatus 30, the user replaces this wire harness 40 with a new one, thereby preventing the wire harness 40 from being further deteriorated.

In the above embodiments, although the fuse element 21 is directly connected to the lead wire 22, the present invention is not limited to such arrangement, but a conductor (made, for example, of an aluminum alloy), which is harder than the fuse element 21 but is softer than the lead wire 22, may be interposed between the fuse element 21 and the lead wire 22. In this case, the detection wire or line becomes softer gradually from the lead wire 22 to the fuse element 21, and therefore the shaping of the detection wire can be effected easily.

As described above, in the temperature fuse of the present invention, when the ambient temperature exceeds a certain temperature, the fuse element is melted, and the fuse element is made of the alloy consisting essentially of 52–100 wt. % indium and the balance tin, and therefore there can be achieved the temperature fuse which is melted with high operating temperature accuracy at a desired predetermined temperature in the range of between 120° C. and 160° C.

In the present invention, an abnormal condition of the vehicle wire harness is detected by the use of the above temperature fuses, and the temperature rise of the wire harness can be detected by the use of the temperature fuses which are melted accurately at the predetermined temperature in the range of 140° C. and 160°, and therefore there can be achieved the vehicle wire harness abnormality detection apparatus in which the abnormal heat generation in the wire harness can be positively detected, thereby preventing the further deterioration of the wire harness due to a rare short or the like.

What is claimed is:

1. A temperature fuse, comprising:

a fuse element which is melted when the ambient temperature exceeds a certain temperature, the fuse element being made of an alloy consisting essentially of 52–100 wt. % indium and the balance tin.

2. The temperature fuse of claim 1, in which the fuse element is covered with a paraffin substance.

3. The temperature fuse of claim 1, in which the fuse element is covered with an insulating film.

4. The temperature fuse of claim 2, in which the paraffin substance is covered with an insulating film.

5. The temperature fuse of claim 3, in which the insulating film is made of a thermosetting resin.

6. The temperature fuse of claim 4, in which the insulating film is made of a thermosetting resin.

7. The temperature fuse of claim 1, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

8. The temperature fuse of claim 2, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

9. The temperature fuse of claim 3, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

10. The temperature fuse of claim 4, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

11. The temperature fuse of claim 5, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

12. The temperature fuse of claim 6, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

13. A temperature fuse, comprising:

a fuse element which is melted when the ambient temperature exceeds a certain temperature, the fuse element being made of an alloy consisting essentially of 85–100 wt. % indium and the balance tin.

14. The temperature fuse of claim 13, in which the fuse element is covered with a paraffin substance.

15. The temperature fuse of claim 13, in which the fuse element is covered with an insulating film.

16. The temperature fuse of claim 14, in which the paraffin substance is covered with an insulating film .

17. The temperature fuse of claim 15, in which the insulating film is made of a thermosetting resin.

18. The temperature fuse of claim 16, in which the insulating film is made of a thermosetting resin.

19. The temperature fuse of claim 13, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

20. The temperature fuse of claim 14, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

21. The temperature fuse of claim 15, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

22. The temperature fuse of claim 16, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

23. The temperature fuse of claim 17, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

24. The temperature fuse of claim 18, in which lead wires are connected respectively to opposite ends of the fuse element so as to cause an electric current to flow through the fuse element, and a conductor, which is harder than the fuse element, but is softer than the lead wire, is interposed between each end of the fuse element and the associated lead wire.

25. The temperature fuse of any one of claims 1 to 24, the temperature fuse being a temperature fuse provided inside or adjacent to a wire harness for a vehicle, wherein an abnormal condition of the wire harness is detected as the temperature fuse is severed.

26. An apparatus for detecting abnormality of a wire harness for a vehicle, comprising:

a temperature fuse comprising a fuse element which is melted when the ambient temperature exceeds a certain temperature, the fuse element being made of an alloy consisting essentially of 52–100 wt. % indium and the balance tin, the temperature fuse being provided inside or adjacent to the wire harness; and means for detecting severing of the temperature fuse so as to detect an abnormal condition of the wire harness.

27. An apparatus for detecting abnormality of a wire harness for a vehicle, comprising:

a temperature fuse comprising a fuse element which is melted when the ambient temperature exceeds a certain temperature, the fuse element being made of an alloy consisting essentially of 85–100 wt. % indium and the balance tin, the temperature fuse being provided inside or adjacent to the wire harness; and means for detecting the severing of the temperature fuse so as to detect an abnormal condition of the wire harness.

* * * * *